US010407273B2

(12) United States Patent
Ginsberg et al.

(10) Patent No.: US 10,407,273 B2
(45) Date of Patent: Sep. 10, 2019

(54) ELEVATOR BRAKING CONTROL SYSTEM

(71) Applicant: OTIS ELEVATOR COMPANY, Farmington, CT (US)

(72) Inventors: David Ginsberg, Granby, CT (US); Xiaodong Luo, South Windsor, CT (US); Shashank Krishnamurthy, Glastonbury, CT (US); Dang V. Nguyen, South Windsor, CT (US); Richard Fargo, Plainville, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 413 days.

(21) Appl. No.: 15/266,452

(22) Filed: Sep. 15, 2016

(65) Prior Publication Data

US 2017/0073183 A1 Mar. 16, 2017

Related U.S. Application Data

(60) Provisional application No. 62/219,503, filed on Sep. 16, 2015.

(51) Int. Cl.

| | |
|---|---|
| ***B66B 1/32*** | (2006.01) |
| ***B66B 11/04*** | (2006.01) |
| ***B66B 9/00*** | (2006.01) |
| ***B66B 5/06*** | (2006.01) |

(52) U.S. Cl.

CPC ..... *B66B 1/32* (2013.01); *B66B 5/06* (2013.01); *B66B 9/003* (2013.01); *B66B 11/0407* (2013.01)

(58) Field of Classification Search

USPC ..... 187/293

See application file for complete search history.

(56) References Cited

U.S. PATENT DOCUMENTS 4,473,135 A * 9/1984 Yonemoto ..... B66B 5/027 187/248
4,974,703 A * 12/1990 Nomura ..... B66B 1/32 187/288

(Continued)

FOREIGN PATENT DOCUMENTS

GB 2402383 A 12/2004
JP 6001558 1/1994

(Continued)

OTHER PUBLICATIONS

Australian Examination Report for application No. 2016228238 dated Aug. 10, 2017, 4 pages.

(Continued)

*Primary Examiner* — Christopher Uhlir

(74) *Attorney, Agent, or Firm* — Cantor Colburn LLP

(57) ABSTRACT

An elevator control system is configured to control an elevator car constructed and arranged to move along a hoistway defined by a stationary structure. The elevator system may include a communication pathway and a hoistway control system supported by the stationary structure and configured to send a continuous brake command signal over the pathway. A car control system is carried by the elevator car and is configured to receive the continuous brake command signal and initiate a brake Ustop mode upon a loss of the brake command signal, and independent of the hoistway control system.

15 Claims, 5 Drawing Sheets

(56) References Cited

U.S. PATENT DOCUMENTS

| | | | | |
|---|---|---|---|---|
| 5,130,617 | A * | 7/1992 | Oshima | B66B 1/28 318/255 |
| 5,393,941 | A | 2/1995 | Mizuno et al. | |
| 5,377,786 | A | 3/1995 | Nakagawa | |
| 5,751,076 | A | 5/1998 | Zhou | |
| 6,170,614 | B1 | 1/2001 | Herkel et al. | |
| 6,305,501 | B1 | 10/2001 | Kahkipuro et al. | |
| 7,573,162 | B2 | 8/2009 | Yura et al. | |
| 8,230,977 | B2 | 7/2012 | Thumm et al. | |
| 9,776,827 | B2 * | 10/2017 | Harkonen | B66B 1/34 |
| 2003/0000778 | A1 * | 1/2003 | Smith | B66B 1/30 187/289 |
| 2006/0163008 | A1 | 7/2006 | Godwin | |
| 2012/0000732 | A1 | 1/2012 | Draper et al. | |
| 2012/0193172 | A1 | 8/2012 | Matscheko et al. | |
| 2018/0105396 | A1 * | 4/2018 | Purosto | B66B 7/044 |

FOREIGN PATENT DOCUMENTS

| | | | |
|---|---|---|---|
| WO | 2007129105 | A1 | 11/2007 |
| WO | 2010031998 | A1 | 3/2010 |
| WO | 2014113006 | A1 | 7/2014 |
| WO | 2014123515 | A1 | 8/2014 |
| WO | 2014189492 | A1 | 11/2014 |
| WO | 2015084370 | A1 | 6/2015 |
| WO | 2016126939 | A1 | 8/2016 |

OTHER PUBLICATIONS

Extended European Search Report for application No. 16275137.4-1731 dated Mar. 1, 2017 (11 pages).

* cited by examiner

ELEVATOR BRAKING CONTROL SYSTEM

BACKGROUND

The present disclosure relates to elevator systems, and more particularly to an elevator braking control system.

Self-propelled elevator systems, also referred to as ropeless elevator systems, are useful in certain applications (e.g., high rise buildings) where the mass of the ropes for a roped system is prohibitive and/or there is a need for multiple elevator cars in a single hoistway. For ropeless elevator systems, it may be advantageous to actuate mechanical braking of the elevator car from the car itself. Similarly, it may be advantageous to actuate or control the propulsion of the elevator car generally from the hoistway side for power distribution and other reasons. To realize both of these advantages, a communication link should exist between the car and the hoistway side to perform reliable braking operations. Improvements in elevator car braking control are desirable should such a communication link fail.

SUMMARY

An elevator control system configured to control an elevator car constructed and arranged to move along a hoistway defined by a stationary structure, the elevator control system according to one, non-limiting, embodiment of the present disclosure includes a pathway; a hoistway control system supported by the stationary structure and configured to send a continuous brake command signal over the pathway; and a car control system carried by the elevator car and configured to receive the continuous brake command signal and initiate a brake Ustop mode upon a loss of the brake command signal, and independent of the hoistway control system.

Additionally to the foregoing embodiment, the car control system includes a brake manager having an electronic processor, a sensor configured to send a sensor signal to the brake manager, and a brake controller, and wherein the brake manager while in the brake Ustop mode is configured to process the sensor signal and, based on the sensor signal, output a Ustop holding brake activation command to the brake controller.

In the alternative or additionally thereto, in the foregoing embodiment, the brake controller includes a holding brake constructed and arranged to activate upon receipt of the Ustop holding brake activation command.

In the alternative or additionally thereto, in the foregoing embodiment, the sensor is a velocity sensor.

In the alternative or additionally thereto, in the foregoing embodiment, the brake manager outputs the Ustop holding brake activation command when a velocity of the elevator car is below a pre-programmed threshold.

In the alternative or additionally thereto, in the foregoing embodiment, the brake manager is configured to monitor elevator car deceleration via the velocity sensor after outputting the Ustop holding brake activation command.

In the alternative or additionally thereto, in the foregoing embodiment, the brake controller includes a secondary brake constructed and arranged to activate upon a Ustop secondary brake activation command from the brake manager.

In the alternative or additionally thereto, in the foregoing embodiment, the brake manager is configured to output the Ustop secondary brake activation command if deceleration of the elevator car after outputting the Ustop holding brake activation command is not below a pre-programmed threshold.

In the alternative or additionally thereto, in the foregoing embodiment, the brake manager applies a pre-programmed algorithm.

In the alternative or additionally thereto, in the foregoing embodiment, the continuous brake command signal includes a no brake command and an apply brake command.

In the alternative or additionally thereto, in the foregoing embodiment, the pathway is wireless and the elevator car is ropeless.

In the alternative or additionally thereto, in the foregoing embodiment, the hoistway control system includes a Ustop manager configured to initiate a Ustop vehicle mode upon the loss of the continuous brake command signal.

In the alternative or additionally thereto, in the foregoing embodiment, the hoistway control system includes a plurality of inverters constructed and arranged to energize a plurality or respective coils of a linear propulsion motor, and wherein the Ustop manager is configured to send a Ustop command signal to the plurality of inverters to slow a speed of the elevator car when in the Ustop vehicle mode.

In the alternative or additionally thereto, in the foregoing embodiment, the Ustop command signal is in accordance with a Ustop speed profile pre-programmed into the hoistway control system.

In the alternative or additionally thereto, in the foregoing embodiment, the sensor is a position sensor.

A method of operating a ropeless elevator control system according to another, non-limiting, embodiment includes initiating a brake Ustop mode of a car control system carried by an elevator car when no communication exists between the car control system and a hoistway control system located remotely from the elevator car; monitoring car velocity during the brake Ustop mode by the car control system; initiating holding brake activation by the car control system when the car velocity falls below a threshold velocity; and bringing the elevator car to a stop.

Additionally to the foregoing embodiment, the method includes initiating a Ustop vehicle mode by the hoistway control system when no communication exists between the car control system and the hoistway control system; and controlling the energization of a plurality of coils of a linear propulsion motor by the hoistway control system to decelerate the elevator car during the Ustop vehicle mode.

In the alternative or additionally thereto, in the foregoing embodiment, the elevator car is decelerated in accordance with a deceleration profile programed into the hoistway control system.

In the alternative or additionally thereto, in the foregoing embodiment, control of energization of the plurality of coils is conducted through a plurality of inverters respectively associated with the plurality of coils.

In the alternative or additionally thereto, in the foregoing embodiment, the method includes monitoring deceleration of the elevator car by the car control system after holding brake activation; and initiating secondary brake activation by the car control system if deceleration does not fall below a threshold value.

The foregoing features and elements may be combined in various combinations without exclusivity, unless expressly indicated otherwise. These features and elements as well as the operation thereof will become more apparent in light of the following description and the accompanying drawings.

However, it should be understood that the following description and drawings are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

Figure 1:
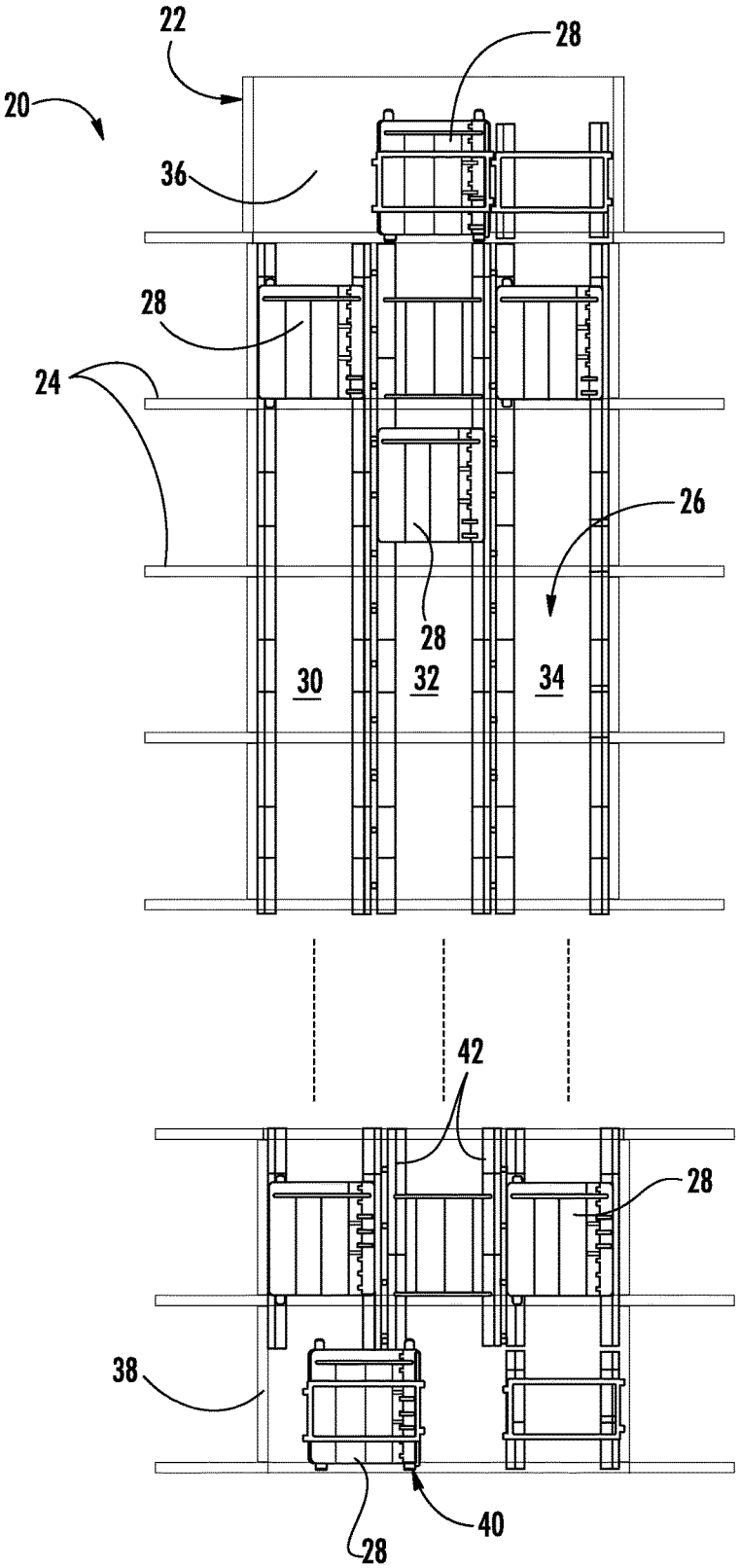
FIG. 1 depicts a multicar elevator system in an exemplary embodiment.

FIG. 1 depicts a self-propelled or ropeless elevator system 20 in an exemplary embodiment that may be used in a structure or building 22 having multiple levels or floors 24. Elevator system 20 includes a hoistway 26 defined by boundaries carried by the structure 22, and at least one car 28 adapted to travel in the hoistway 26. The hoistway 26 may include, for example, three lanes 30, 32, 34 with any number of cars 28 traveling in any one lane and in any number of travel directions (e.g., up and down). For example and as illustrated, the cars 28 in lanes 30, 34, may travel in an up direction and the cars 28 in lane 32 may travel in a down direction.

Above the top floor 24 may be an upper transfer station 36 that facilitates horizontal motion to elevator cars 28 for moving the cars between lanes 30, 32, 34. Below the first floor 24 may be a lower transfer station 38 that facilitates horizontal motion to elevator cars 28 for moving the cars between lanes 30, 32, 34. It is understood that the upper and lower transfer stations 36, 38 may be respectively located at the top and first floors 24 rather than above and below the top and first floors, or may be located at any intermediate floor. Yet further, the elevator system 20 may include one or more intermediate transfer stations (not illustrated) located vertically between and similar to the upper and lower transfer stations 36, 38.

Figure 2:
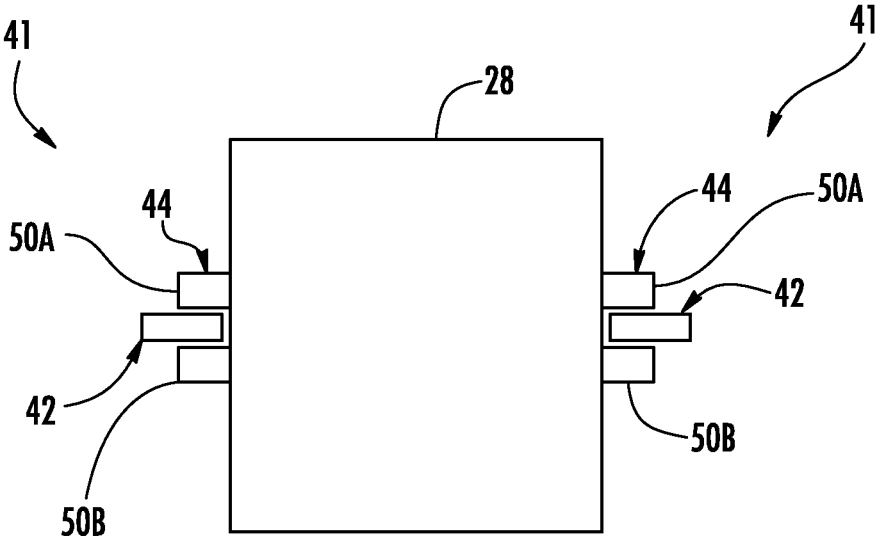
FIG. 2 is a top down view of a car and portions of a linear propulsion system in an exemplary embodiment.
Figure 3:
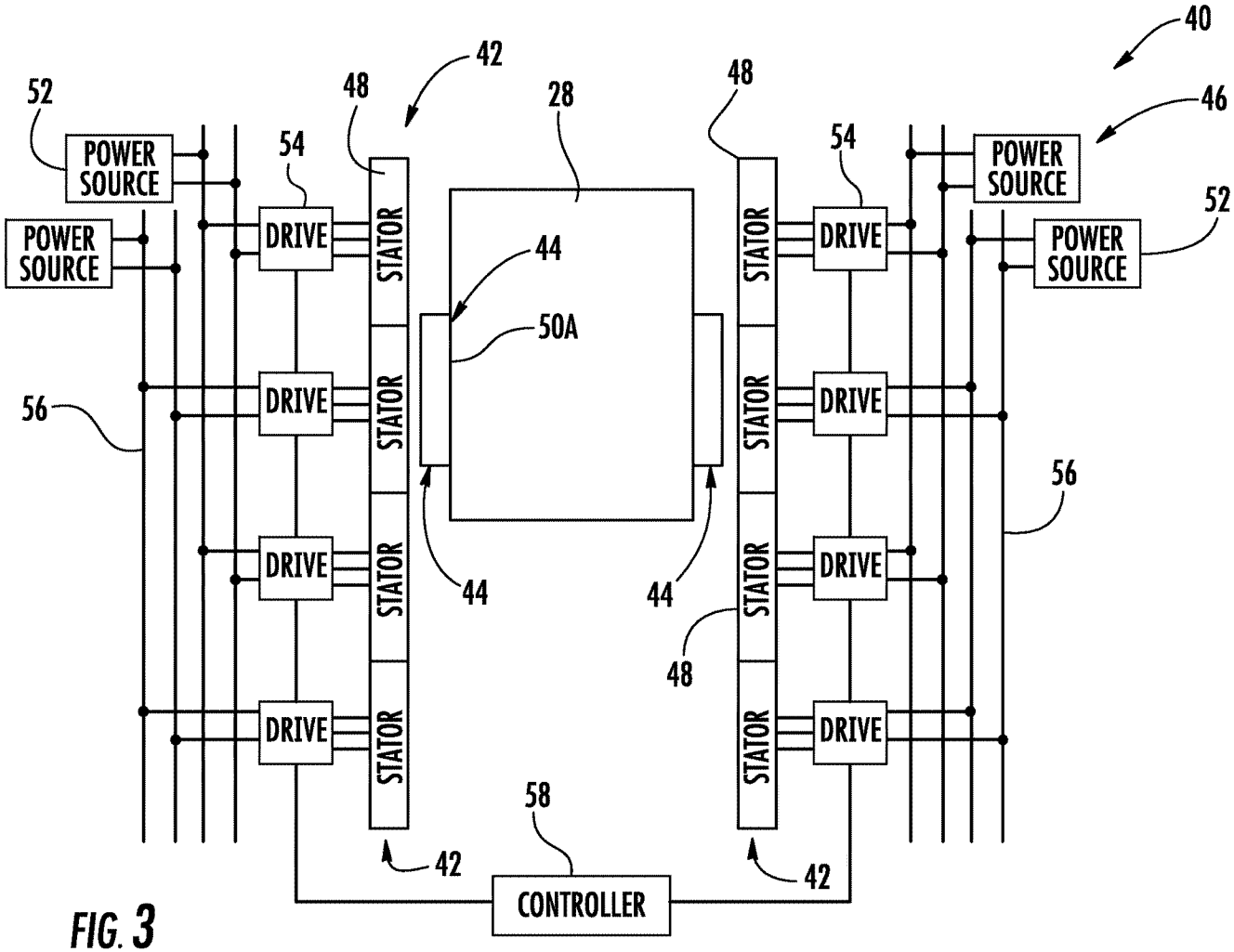
FIG. 3 is a schematic of the linear propulsion system.

Referring to FIGS. 1 through 3, the cars 28 are propelled using a linear propulsion system 40 that may have two linear propulsion motors 41 that may be generally positioned on opposite sides of the elevator cars 28, and a control system 46 (see FIG. 3). Each motor 41 may include a fixed primary portion 42 generally mounted to the building 22, and a moving secondary portion 44 mounted to the elevator car 28. The primary portion 42 includes a plurality of windings or coils 48 that generally form a row extending longitudinally along and projecting laterally into each of the lanes 30, 32, 34. Each secondary portion 44 may include two rows of opposing permanent magnets 50A, 50B mounted to each car 28. The plurality of coils 48 of the primary portion 42 are generally located between and spaced from the opposing rows of permanent magnets 50A, 50B. Primary portion 42 is supplied with drive signals from the control system 46 to generate a magnetic flux that imparts a force on the secondary portions 44 to control movement of the cars 28 in their respective lanes 30, 32, 34 (e.g., moving up, down, or holding still). It is contemplated and understood that any number of secondary portions 44 may be mounted to the car 28, and any number of primary portions 42 may be associated with the secondary portions 44 in any number of configurations. It is further understood that each lane may be associated with only one linear propulsion motor 41 or three or more motors 41. Yet further, the primary and secondary portions 42, 44 may be interchanged.

Referring to FIG. 3, the control system 46 may include power sources 52, drives 54 (i.e., inverters), buses 56 and a controller 58. The power sources 52 are electrically coupled to the drives 54 via the buses 56. In one non-limiting example, the power sources 52 may be direct current (DC) power sources. DC power sources 52 may be implemented using storage devices (e.g., batteries, capacitors), and may be active devices that condition power from another source (e.g., rectifiers). The drives 54 may receive DC power from the buses 56 and may provide drive signals to the primary portions 42 of the linear propulsion system 40. Each drive 54 may be an inverter that converts DC power from bus 56 to a multiphase (e.g., three phase) drive signal provided to a respective section of the primary portions 42. The primary portion 42 may be divided into a plurality of modules or sections, with each section associated with a respective drive 54.

The controller 58 provides control signals to each of the drives 54 to control generation of the drive signals. The controller 58 may provide thrust commands from a motion regulator (not shown) to control generation of the drive signals by the drives 54. The drive output may be a pulse width modulation (PWM). Controller 58 may be implemented using a processor-based device programmed to generate the control signals. The controller 58 may also be part of an elevator control system or elevator management system. Elements of the control system 46 may be implemented in a single, integrated module, and/or may be distributed along the hoistway 26.

Figure 4:
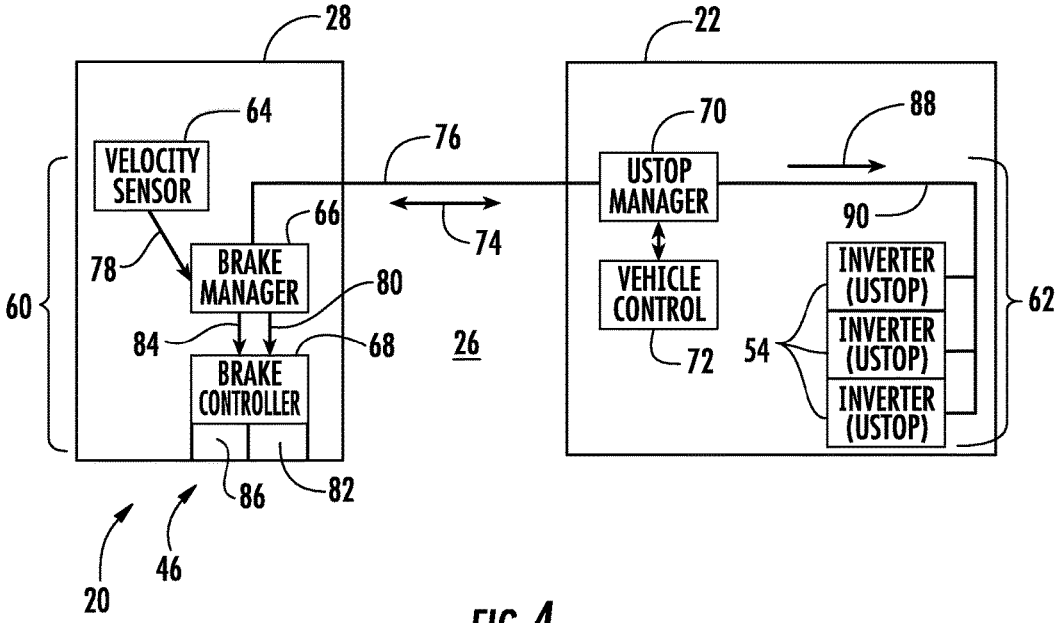
FIG. 4 is a schematic of car and hoistway control systems of the elevator system.

Referring to FIG. 4, the control system 46 may further include a car control system 60 carried by each elevator car 28 and a hoistway control system 62 located remotely from the elevator car and generally supported, at least in-part, by the stationary structure 22. The car control system 60 includes a sensor 64, a brake manager 66, and a brake controller 68. The hoistway control system 62 may include a Ustop manager 70, a vehicle control 72 and the plurality of inverters 54 (also see FIG. 3). The Ustop manager 70 and/or the vehicle control 72 may be an integral part of the controller 58. During normal elevator car 28 operation, a continuous brake command signal (see arrow 74) is sent between the brake manager 66 and the Ustop manger 70 via a pathway 76 that may be wireless. The continuous brake command signal 74 may generally include a no brake command and an apply brake command. The term 'Ustop", or Ustop action, refers to an urgent stop, which is initiated when the system determines that it may be undesirable for the elevator to continue moving along a planned velocity profile. In general, a Ustop action may be accomplished through either controlling elevator motor(s), and/or engaging one or more braking devices.

The brake manager 66 may include an electronic processor and a computer readable storage medium for receiving and processing car velocity signals (see arrow 78) received from the velocity sensor 64 and comparing such data to pre-programed velocity and/or deceleration profiles, via, for example, a pre-programmed algorithm. Based on processing of the velocity signals 78 by the brake manager 66, the brake controller 68 may receive a Ustop holding brake activation command signal (see arrow 80) to activate a holding brake 82 from the brake manager 66. Also based on velocity signals 78, the brake controller 68 may receive a Ustop secondary brake activation command signal (see arrow 84) to activate a secondary brake 86 from the brake manager 66. It is further contemplated and understood that the sensor 64 may be a type of position sensor which is used to calculate velocity by viewing change in car position over a period of time. It is further understood that the holding brake activation command signal 80 may generally be the same signal applied during normal operation (i.e., not just Ustop operation). Moreover, the holding and secondary brakes may be operated by different brake controllers, and the holding brake may be a plurality of brakes applied selectively to control elevator car deceleration.

The Ustop manager 70 of the hoistway control system 62 generally makes the determination of when Ustop action is needed (i.e., any variety of unsafe conditions is detected). In the present disclosure, the unsafe condition is the loss of communication (e.g., signal 74) between the car and hoistway control systems 60, 62. The Ustop manager 70 may include an electronic processor and a computer readable storage medium configured to output a Ustop command signal (see arrow 88) to the plurality of inverters 54 over a pathway 90. The Ustop manager 70 control of the plurality of inverters 54 during a Ustop mode of operation may be based, at least in-part, on a pre-programmed deceleration profile. The Ustop manager 70 may utilize a pre-programmed algorithm to, at least in-part, compare actual deceleration of the elevator car 28 to the deceleration profile. The Ustop command signal is either on or off. The progress of the elevator car may be monitored during the Ustop mode, but (as one, non-limiting, example) the only commands that may be issued to the inverters 54 is to go into the Ustop mode. There may be no other coordination needed between drives for this operation. The pathway 90 may be wired or wireless.

Figure 5:
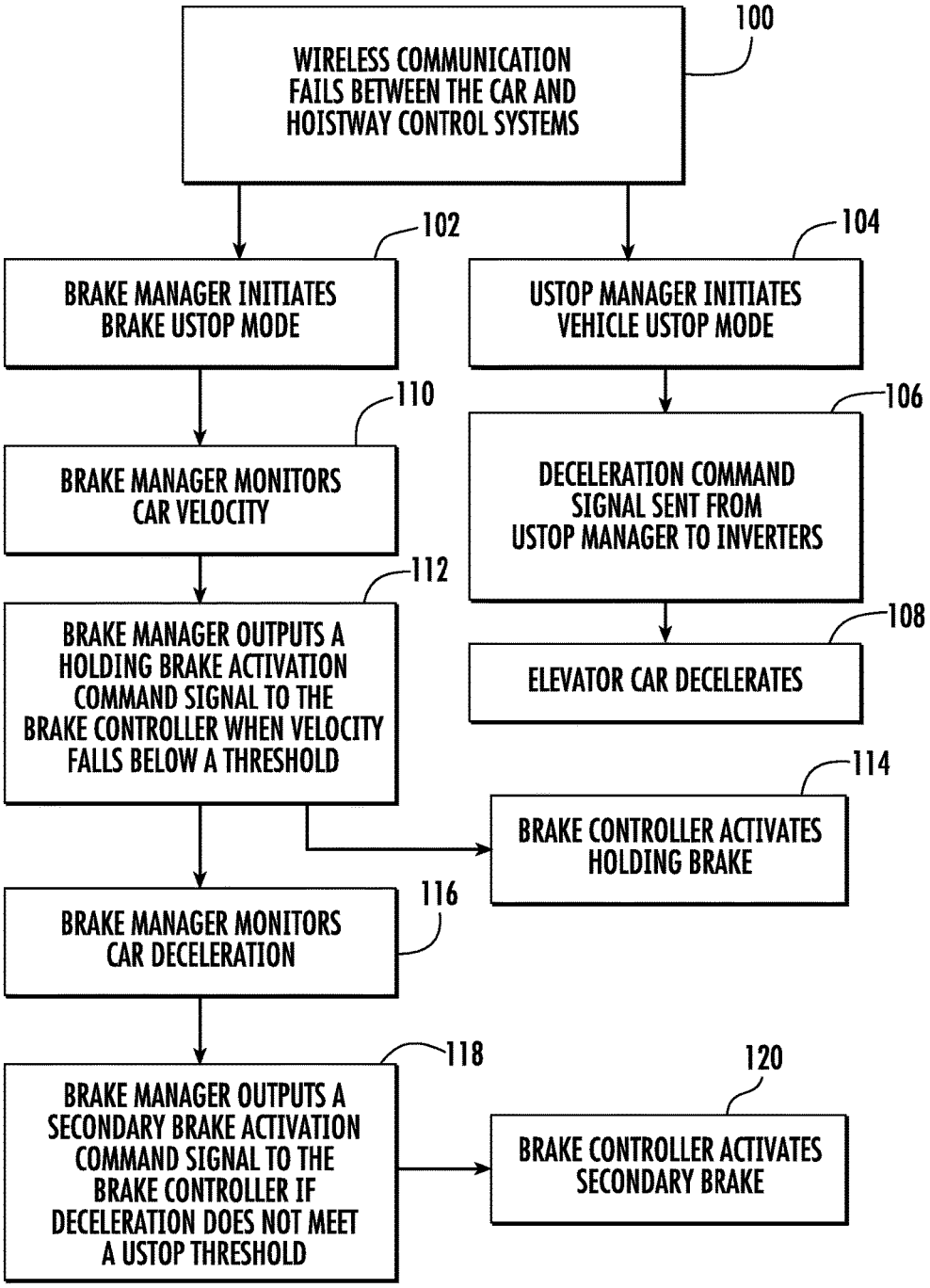
FIG. 5 is a block diagram of a method of operating an elevator control system having the car and hoistway control systems.

Referring to FIGS. 4 and 5, upon a loss of communication between the car and hoistway control systems 60, 62 (e.g., failure of the continuous brake command signal 74, see block 100 in FIG. 5), the brake manager 66 of the car control system 60 may initiate the brake Ustop mode (see block 102). Independently and what may be simultaneously, the Ustop manager 70 of the hoistway control system 62 may initiate a vehicle Ustop mode (see block 104). When in the vehicle Ustop mode, the Ustop manager 70 may send a deceleration command signal 88 (i.e., the Ustop command signal) to the plurality of inverters 54 (see block 106) resulting in deceleration of the elevator car 28 (see block 108). The term 'brake Ustop' generally refers to a stopping means that deploys a braking device that may act on guide rails, and does not rely on a propulsion and/or motorized system.

When the hoistway control system 62 is in the vehicle Ustop mode, the car control system 60 may be in the brake Ustop mode. When in the brake Ustop mode, the brake manager 66 monitors the velocity of the car 28 (see block 110) in preparation of applying the holding brake 82 without creating excessive G-forces. Although functioning independently, during this monitoring time span, the elevator car 28 may be decelerating due to the deceleration command from the Ustop manager 70 to the plurality of inverters 54. When the velocity falls below a threshold pre-programmed into the brake manager 66, the brake manager outputs a holding brake activation command signal 80 to the brake controller 68 (see block 112). Upon receipt, the brake controller 68 may activate the holding brake 82 (see block 114) to bring the elevator car 28 to a relatively quick or urgent stop.

After sending the holding brake activation command signal 80, the brake manager 66 may continue to monitor deceleration of the elevator car 28 (see block 116). After a pre-programmed time period, if the deceleration does not meet a pre-programmed threshold, the brake manager 66 may output a secondary brake activation command signal 84 to the brake controller 68 (see block 118). Upon receipt, the brake controller 68 may activate a secondary brake 86 (see block 120) to further decelerate the elevator car 28.

While the present disclosure is described with reference to exemplary embodiments, it will be understood by those skilled in the art that various changes may be made and equivalents may be substituted without departing from the spirit and scope of the present disclosure. In addition, various modifications may be applied to adapt the teachings of the present disclosure to particular situations, applications, and/or materials, without departing from the essential scope thereof. For example, the elevator system may not be a ropeless elevator system, and may apply to any type of elevator system including cabled elevator systems. The present disclosure is thus not limited to the particular examples disclosed herein, but includes all embodiments falling within the scope of the appended claims.

What is claimed is:

1. An elevator control system configured to control an elevator car constructed and arranged to move along a hoistway defined by a stationary structure, the elevator control system comprising:

a pathway;

a hoistway control system supported by the stationary structure and configured to send a continuous brake command signal over the pathway; and a car control system carried by the elevator car and configured to receive the continuous brake command signal and initiate a brake Ustop mode upon a loss of the brake command signal, and without a further command from, the hoistway control system.

2. The elevator control system set forth in claim 1, wherein the car control system includes a brake manager having an electronic processor, a sensor configured to send a sensor signal to the brake manager, and a brake controller, and wherein the brake manager while in the brake Ustop mode is configured to process the sensor signal and, based on the sensor signal, output a Ustop holding brake activation command to the brake controller.

3. The elevator control system set forth in claim 2, wherein the brake controller includes a holding brake constructed and arranged to activate upon receipt of the Ustop holding brake activation command.

4. The elevator control system set forth in claim 3, wherein the sensor is a velocity sensor.

5. The elevator control system set forth in claim 4, wherein the brake manager outputs the Ustop holding brake activation command when a velocity of the elevator car is below a pre-programmed threshold.

6. The elevator control system set forth in claim 5, wherein the brake manager is configured to monitor elevator car deceleration via the velocity sensor after outputting the Ustop holding brake activation command.

7. The elevator control system set forth in claim 6, wherein the brake controller includes a secondary brake constructed and arranged to activate upon a Ustop secondary brake activation command from the brake manager.

8. The elevator control system set forth in claim 7, wherein the brake manager is configured to output the Ustop secondary brake activation command in response to deceleration of the elevator car after outputting the Ustop holding brake activation command not being below a pre-programmed threshold.

9. The elevator control system set forth in claim 8, wherein the brake manager applies a pre-programmed algorithm.

10. The elevator control system set forth in claim 1, wherein the continuous brake command signal includes a no brake command and an apply brake command.

11. The elevator control system set forth in claim 1, wherein the pathway is wireless and the elevator car is ropeless.

12. The elevator control system set forth in claim 1, wherein the hoistway control system includes a Ustop manager configured to initiate a Ustop vehicle mode upon the loss of the continuous brake command signal.

13. The elevator control system set forth in claim 12, wherein the hoistway control system includes a plurality of inverters constructed and arranged to energize a plurality or respective coils of a linear propulsion motor, and wherein the Ustop manager is configured to send a Ustop command signal to the plurality of inverters to slow a speed of the elevator car when in the Ustop vehicle mode.

14. The elevator control system set forth in claim 13, wherein the Ustop command signal is in accordance with a Ustop speed profile pre-programmed into the hoistway control system.

15. The elevator control system set forth in claim 3, wherein the sensor is a position sensor.

* * * * *